United States Patent [19]

Lee

[11] Patent Number: 4,663,605

[45] Date of Patent: May 5, 1987

[54] CLAMPING MEANS FOR THE CORE AND COIL ASSEMBLY OF AN ELECTRIC TRANSFORMER

[75] Inventor: Albert C. Lee, Hickory, N.C.

[73] Assignee: General Electric Company, King of Prussia, Pa.

[21] Appl. No.: 884,663

[22] Filed: Jul. 15, 1986

Related U.S. Application Data

[63] Continuation of Ser. No. 813,113, Dec. 24, 1985, abandoned.

[51] Int. Cl.[4] ..... H01F 27/26; H01F 27/30

[52] U.S. Cl. ..... 336/197; 336/92; 336/210; 336/217; 336/234

[58] Field of Search ..... 336/90, 92, 94, 58, 336/197, 210, 216, 217, 233, 234

[56] References Cited

U.S. PATENT DOCUMENTS 2,930,012 3/1960 Hufnagel ..... 336/210 X
3,082,390 3/1963 Peterson ..... 336/210
3,227,982 1/1966 Hefferman ..... 336/210

OTHER PUBLICATIONS

Three Photographs of ISKVA Distribution Transformer, Manufactured by Westinghouse Electric Corp; having Ser. No. 84A042915.

*Primary Examiner*—Thomas J. Kozma
*Attorney, Agent, or Firm*—William Freedman; Henry J. Policinski

[57] ABSTRACT

This transformer comprises a generally rectangular core having two yokes and two legs connecting the yokes, with joints located in one of the yokes. Coil structures surround the two legs. Flexible banding under tension applies clamping forces to two clamping plates spaced outwardly from the yokes, and these clamping forces are transmitted to the coil structures by paths bypassing the core. The banding extends alongside the legs and is oriented so as to engage the core at opposite ends of said one yoke but so as to be spaced from the core at opposite ends of the other yoke.

16 Claims, 4 Drawing Figures

CLAMPING MEANS FOR THE CORE AND COIL ASSEMBLY OF AN ELECTRIC TRANSFORMER

This application is a continuation of application Ser. No. 813,113, filed Dec. 24, 1985, now abandoned.

This invention relates to clamping means for the core and coil assembly of an electric transformer and, more particularly, to clamping means of this type in which the core is of amorphous metal.

To maintain the parts of the core and coil assembly in the proper positions for which they are designed and for enabling them to more effectively resist the forces developed during shipment, installation, and operation of the tranformer, it is necessary that suitable clamping means be provided for holding these parts together. In a distribution transformer, typical clamping means for this purpose comprises horizontal clamping plates at the top and bottom of the core and coil assembly and a flexible band, or strap, which extends between the two clamping plates at opposite sides of the assembly. The band is placed under tension to develop clamping forces which urge the two clamping plates toward each other, and suitable force-transmitting means is provided between the plates and the coil structure to transmit these clamping forces to opposite ends of the coil structure.

A problem encountered in a transformer with an amorphous metal core is that the forces developed by clamping means of the type described hereinabove can seriously impair the magnetic performance of the core. This is because amorphous metal is very sensitive to mechanical stresses, and the core tends to be stressed by the above-described clamping forces in a way that impairs its magnetic performance, i.e., increases core losses and exciting current.

OBJECTS AND SUMMARY

An object of my invention is to provide, for an amorphous-metal cored transformer, clamping means which is capable of effectively holding the parts of the core and coil assembly in their proper positions and yet does not seriously impair the magnetic performance of the amorphous metal core.

In one form of my invention the core is of generally rectangular configuration and comprises two spaced-apart yokes and two spaced-apart legs at opposite ends of yokes, with a single one of said yokes containing joints. Another object of my invention is to provide clamping means capable of performing as in the immediately-preceding object and also capable of exerting forces on such a core that act almost entirely longitudinally of said single yoke and virtually not at all longitudinally of said legs.

In carrying out the invention in one form, I provide in combination with said core of rectangular configuration, coil structures respectively surrounding said legs and having passageways through which said legs extend. Clamping plates are provided at the yoke ends of said core and are spaced outwardly from the core. Means is provided for applying clamping forces to the plates to urge the plates together. Force-transmitting members transmit the clamping forces to the coil structures by paths bypassing the core. The clamping-force-applying means comprises flexible banding that extends through the coil passageways, alongside said legs, is held under tension, and engages said core at opposite ends of the single yoke containing the joints, thereby exerting forces on said single yoke acting longitudinally thereof. The banding is oriented so as to be spaced, from said core at opposite ends of the other of said yokes.

BRIEF DESCRIPTION OF DRAWINGS

For a better understanding of the invention, reference may be had to the following description taken in conjunction with the accompanying drawings, wherein.

DETAILED DESCRIPTION OF PREFERRED EMBODIMENT

Figure 1:
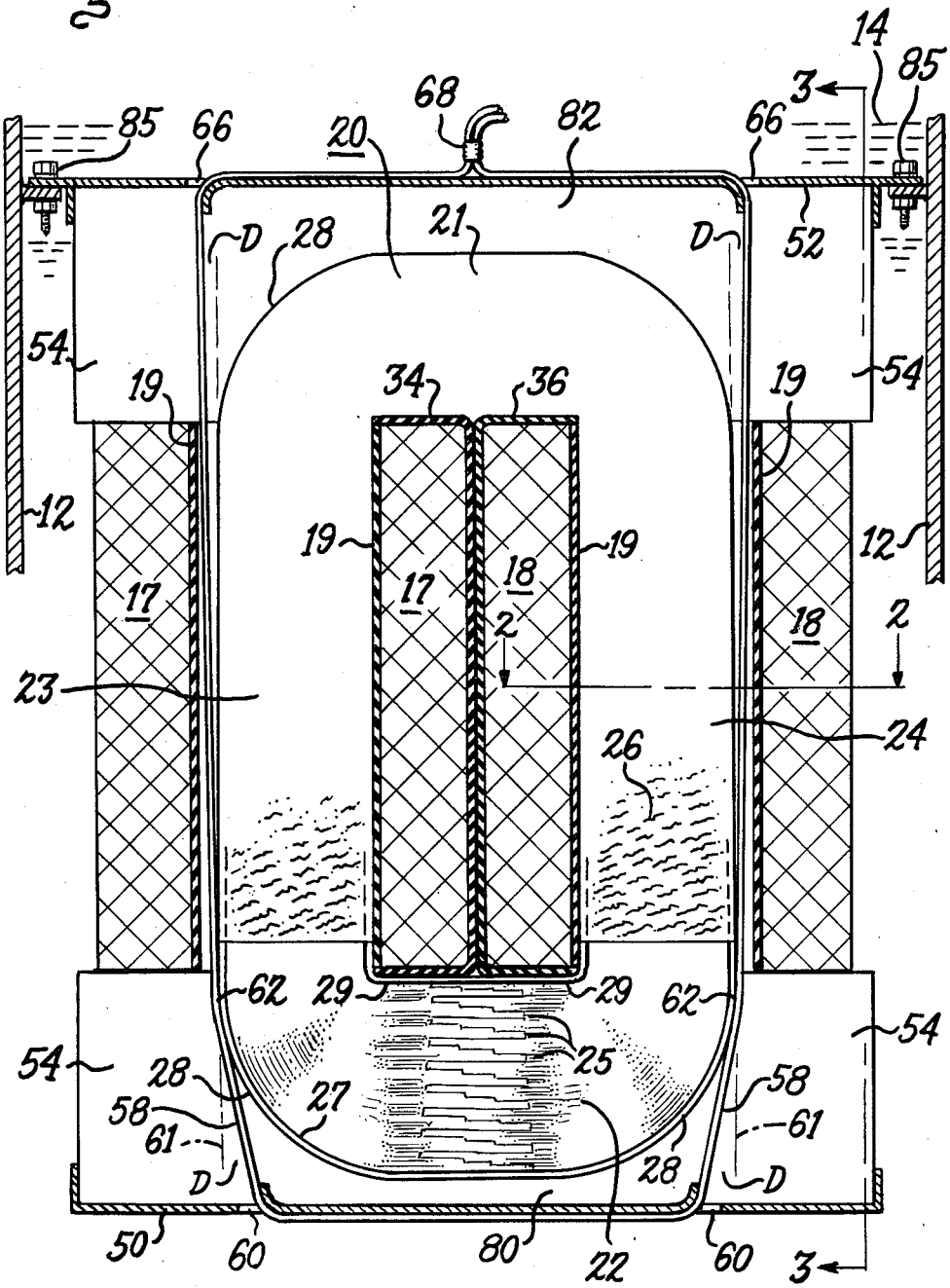
FIG. 1 is a front elevational view, partly in section and partly schematic, showing a core and coil assembly embodying one form of my invention.

Referring now to FIG. 1, the transformer shown therein is a distribution transformer comprising a metal tank, a portion of which is shown at 12, containing an insulating liquid 14. Within the insulating liquid is the core and coil assembly 15 of the transformer. This assembly 15 comprises two coils 17 and 18 and a wound laminated core 20 of amorphous ferromagnetic alloy linked to the coils.

Figure 2:
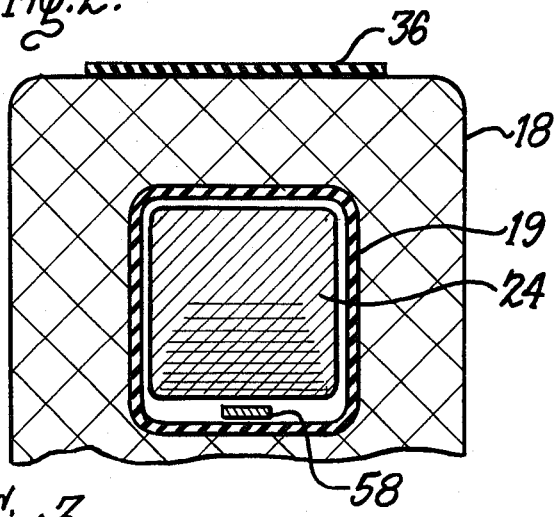
FIG. 2 is a sectional view along the line 2—2 of FIG. 1.

The coils 17 and 18 are made in a conventional manner, preferably, being pre-wound before being incorporated into the assembly 15. Each coil comprises a hollow winding form 19 of insulating material and suitable windings (the details of which are not shown) surrounding the form 19. In the illustrated transformer, as best seen in FIG. 2, the winding form 19 is a thin-walled tubular structure having a rectangular cross-section, and each of the coils has a rectangular configuration when viewed in horizontal cross-section. The interior of form 19 defines a central passageway through the associated coil.

Prior to its incorporation into assembly 15, the core 20 is made from amorphous alloy in strip form, such as that commercially available from Allied Corporation as its Metglas 2506-S2 material. The core may be made in any number of different ways, but the illustrated core is preferably made by winding the amorphous strip into an annular form (not shown), cutting the annular form along a single radial line thereby creating separate laminations, and then reassembling the laminations to form a second annulus (not shown) with distributed gap lap joints in a localized region of the second annulus. Then the second annulus is formed into the generally rectangular shape shown in FIG. 1, so that it comprises four integrally-connected sides consisting of two yokes 21 and 22 and two legs 23 and 24 at opposite ends of the yokes, with the joints (shown at 25) being located in yoke 22. In the formed rectangular core, each of the yokes 21 and 22 has rounded surfaces 28 at its outer ends that merge smoothly into the outer planar surfaces of the adjacent legs 23 and 24. After this forming step, the core is annealed to relieve the stresses resulting from the earlier fabrication steps. Then, a thin layer of adhesive bonding agent, shown at 26 in FIG. 1, is applied to the lateral edges of the laminations in the upper yoke 21 and in the two legs 23 and 24. The lower yoke 22 and the corner regions of the core at opposite ends of the lower yoke are kept free of this bonding agent in order to permit ready displacement of these core portions during subsequent lacing of the core into the coils. After bonding, the joints 25 are opened, and the portions of the yoke 22 at opposite sides of the joints 25 are displaced into positions of alignment with the legs 23 and 24 to convert the core into a U-shaped structure that can be easily laced into the two pre-wound coils 17 and 18.

Lacing is accomplished by simultaneously inserting one leg of the above-described U-shaped core structure into the central passageway of pre-wound tubular winding 17 and the other leg into the central pasageway of pre-wound tubular winding 18. Thereafter the displaced yoke portions of the core are returned to their closed-joint positions of FIG. 1 to remake the joints 25.

Before the core is laced into the coils as above described, two channel-shaped insulating members 34 and 36, referred to as core shields, are respectively applied to the coils in the locations shown in FIG. 1. The horizontal flanges of these channel-shaped members act as spacers which prevent the inner surfaces of the yokes 21 and 22 from directly contacting the edges of coils 17 and 18 and thus reducing the dielectric strength of the coil structure. The insulating members 34 and 36 also space and provide insulation between the juxtaposed outer peripheries of the coils 17 and 18.

The core 20 also comprises, in addition to the above-described amorphous metal parts, an outer wrapper 27 of silicon steel that closely surrounds the amorphous metal laminations and is bonded thereto by the adhesive coating 26. Only a portion of the outer wrapper is shown on FIG. 1, but it should be understood that it extends completely around the outer periphery of the core. The core also comprises an inner liner 29 of silicon iron that snugly fits within the amorphous metal laminations and is bonded thereto by adhesive coating 26. The outer wrapper 27 and the inner liner 29, among other functions, help to protect the amorphous metal laminations of the core against mechanical damage during manufacture, installation, and operation of the core. The wrapper 27 and the liner 29 are preferably made of the same type of silicon iron strip that is typically used for the cores of conventional distribution transformers, having a thickness of about 10 mils as compared to a typical thickness of about 1 mil for the amorphous metal strip.

To maintain the parts of the core and coil assembly 15 in the proper positions for which they are designed and for enabling them to more effectively resist the forces developed during shipment, installation, and operation of the transformer, clamping means is provided for holding these parts together. This clamping means comprises a bottom clamping plate 50, a top clamping plate 52, and a flexible band 58, preferably of steel, that extends between these clamping plates at opposite sides of the assembly. The flexible band 58 extends through spaced openings 60 in the bottom clamping plate 50, upwardly through the central passageways of the coils 17 and 18, then through spaced openings 66 in the upper clamping plate 52. Preferably the band is looped around the portion of the bottom plate between openings 60 and has its upper ends connected together by means of a suitable clip 68.

Figure 3:
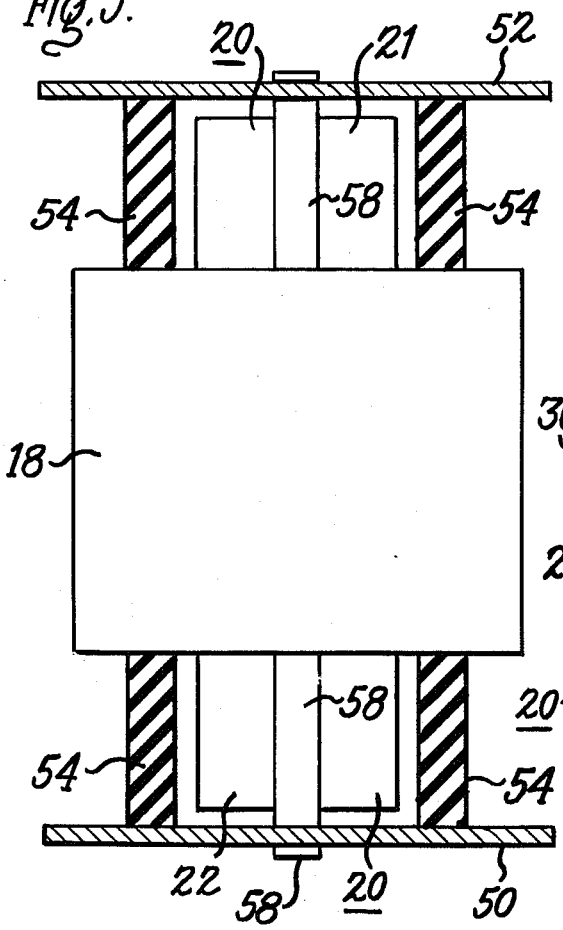
FIG. 3 a sectional view along the line 3—3 of FIG. 1.

The band 58 is suitably tightened to place it in tension, thereby developing clamping forces which urge plates 50 and 52 toward each other. The clamping forces are transmitted from the clamping plates 50 and 52 to the coil structure 17, 18 by means of rigid force-transmitting plates 54 of insulating material that are located between the clamping plates 50, 52 and the coil structure 17, 18. These plates 54 are disposed perpendicular to the clamping plates 50, 52 and are located adjacent opposite faces of the core, as best seen in FIG. 3. The upper plates 54 bear on the top surface of coil structure 17, 18, and the lower plates 54 bear on the bottom surface of coil structure 17, 18. The coil structure is clamped between these plates 54 when the band 58 is tightened. Plates 54 have sufficient height to leave clearances at 80 and 82 between the core 20 and the end plates 50 and 52, respectively, and thus to avoid applying clamping forces from the plates 50 and 52 to the core 20.

As pointed out in the introductory portion of this specification, it is important to prevent the above-described clamping forces from stressing the amorphous metal core 20 in a way that will impair its magnetic performance. To this end, I essentially eliminate any transmission to the core 20 of vertical forces applied by the clamping means. These forces are applied almost entirely to the coil structure 17 and 18, rather than to the core 20, as a result of the clearances 80 and 82 that cause the vertical clamping forces to bypass the core 20.

The core 20 is prevented from moving in a vertical direction by the coil structure 17, 18, including the channel-shaped core shields 34 and 36. This stationary structure is located within the window of the core and has virtually no vertical clearance with respect to the core and, hence, is capable of restraining any vertical motion of the core. The coil structure is rendered stationary by reason of the top clamping plate 52 being fixed to the stationary tank 12. For this purpose, mounting bolts 85 are provided for connecting together abutting portions of the top clamping plate and the tank.

Figure 1A:
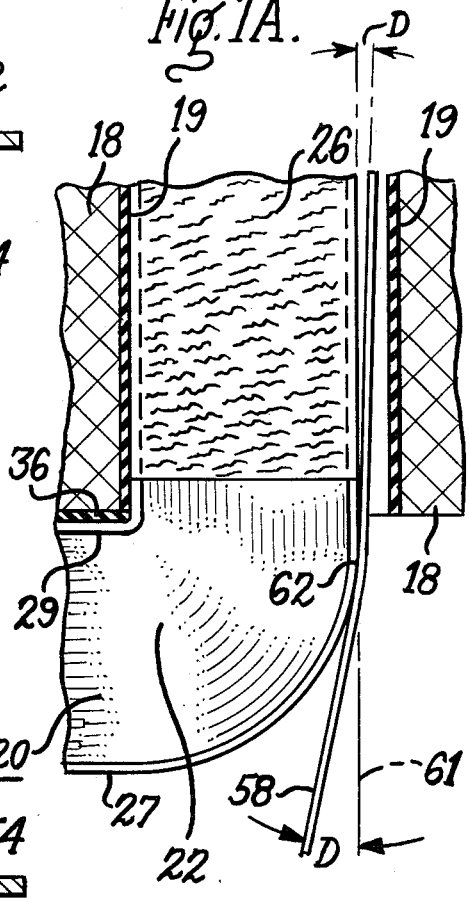
FIG. 1A is an enlarged view of a portion of FIG. 1.

Referring to FIGS. 1 and 1A, the core 20 is prevented from moving in a horizontal direction by the steel band 58 itself. In this respect, the holes 60 in the lower clamping plate 50 are so located that the band 58, which is positioned by holes 60, contacts the core on the rounded surfaces 28 at opposite ends of the lower yoke 22. In one embodiment of the invention, the band 58 makes an angle D of about 3 degrees at each end of the yoke with a reference plane 61 containing the vertical outer surface of the associated leg 23 or 24 of the core. In effect, the band 58 is wrapped around the core at the rounded ends of the lower yoke, contacting the core at locations 62. If the band is disposed inside the reference plane 61, the angle between the band and the reference plane is considered to be a positive angle, and if disposed outside this plane, this reference angle is considered to be negative.

At the ends of the upper yoke 21, the band 58 is out of contact with the core. In a preferred embodiment, I locate the holes 66 in the upper clamping plate 52 so that at the upper ends of core legs 23 and 24, the angle D between the band and the associated vertical reference plane is between zero degrees and −2 degrees.

By orienting the band 58 as described above in connection with the preferred embodiment, I apply horizontal forces through the band 58 to the core only at the ends of the lower yoke 22. The band 58, being out of contact with the upper yoke 21, applies no substantial horizontal forces thereto (except as transmitted through the lower yoke 22). Tightening of the band applies no substantial horizontal forces to the legs 23, 24 (except as transmitted through the lower yoke 22) since the band angle with respect to the outer surface of each associated leg remains between zero degrees and a negative value at all points between the locations 62 and the holes 66 in the upper clamping plate 52.

While the preferred angle D at each end of the bottom yoke is 3° or less, a maximum value for this angle is about 6°. If a greater value is used for this angle, the horizontal forces on the lower yoke are so high that the resulting stresses unduly increase the core losses and exciting current. While the preferred angle D at each end of the top yoke is between 0 and −2°, this angle can be increased in a negative direction to a maximum of about −6°. If a greater value is used for this angle, the core winding form 19 must be unduly large in order to accommodate banding 58 or else the banding bears with an unduly high force against the inside face of the radially-outer side of the winding form, thus creating a risk of cutting the winding form and damaging adjacent winding insulation.

Tests have been made to determine the effect of band orientation on core losses and exciting current in an amorphous steel core of substantially the configuration shown disposed in a core and coil assembly of substantially the design shown. In these tests, core loss and exciting current were measured first with 120 volts (i.e., rated excitation) and then with 132 volts (110% rated excitation) applied to the secondary winding of the transformer, with the primary winding open circuited. The following results were obtained:

| Voltage | Core Loss (watts) | Exciting Current (amperes) |
|---|---|---|
| Sample #1 | | |
| 120 v. | 20.2 | .892 |
| 132 v. | 26.6 | 3.23 |
| Sample #2 | | |
| 120 v. | 18.6 | .566 |
| 132 v. | 24.7 | 2.33 |
| Sample #3 | | |
| 120 v. | 18.3 | .499 |
| 132 v. | 24.5 | 2.17 |

Sample #1 had a positive angle D of 5.4° at both the bottom and top yokes. Sample #2 was the same as Sample #1 except that the band 58 was cut in Sample #2 so that no forces were applied to the core therethrough. Sample #3 was the same as Sample #1 except that the band 58 had a positive angle D of 5.4° at the bottom yoke and a negative angle D of 2° at the top yoke.

It will be seen that Sample #3, compared to Sample #1, had a reduction in exciting current of about 44% at 120 V and of about 32% at 132 V. This was even better than the results achieved with Sample #2, where the band was cut, producing drops in exciting current of 36.5% and 27.9% at 120 V and 132 V, respectively, as compared to Sample #1.

It will be seen further that Sample #3, compared to Sample #1, had a reduction in core loss of 9.4% and 7.9% at 120 V and 132 V, respectively. This was slightly better than the 7.9% and 7.1% reductions achieved with Sample #2.

My studies indicate that the relatively low compressive forces applied to the bottom yoke longitudinally thereof had a beneficial effect on the magnetic performance of the joints 25 in the bottom yoke. In the case of the lap joints shown, it appears that these forces are helpful in maintaining the appropriate overlap at the joints 25 despite separating forces that might be developed on the joints as a result of shipping, installation, or operation of the transformer. Maintaining the appropriate overlap insures against localized saturation at the joint region. While the relatively low stresses produced in the lower yoke by the above-described forces tend to increase the losses therein, these increases are more than offset by the improved performance of the joints.

In cores where the joints 25 are butt joints instead of the lap joints shown, the moderate longitudinal compressive forces on the lower yoke are also beneficial. With such butt joints, these longitudinal compressive forces help to hold the butt joints closed with a minimum gap length, thus preventing excessive flux from by-passing the joints through adjacent laminations and thus saturating these adjacent laminations.

It has been pointed out hereinabove that the core includes an outer wrapper 27 of silicon iron that is relatively thick compared to the amorphous metal laminations. This outer wrapper 27 helps to distribute the forces directed longitudinally of the yoke 22 over relatively large areas at the ends of yoke 22, thus avoiding localized stress concentrations that could detract from the magnetic performance of the amorphous alloy and applying the forces more uniformly to the joints 25 so that more of the joints benefit in the above-described manner from such forces.

While I have illustrated only a single band being used for clamping purposes, it will be understood that a plurality of side-by-side bands could equally well be used. In such an arrangement, each band would be of substantially the same configuration as shown in FIG. 1.

In the illustrated transformer, the band 58 serves not only as a key element of the above-described clamping means but also as a very effective means for connecting the core 20 to ground. In this respect, the band makes good electrical contact with the outer wrapper 27 of the core at locations 62 and also makes good electrical contact with the upper clamping plate 52 at the edge of holes 66. Clamping plate 52 is connected to ground through the bolted connection at 85 with the tank 12, which is at ground potential. To insure that good contact is achieved between the band 58 and the outer wrapper 27, any coating on the outer wrapper is of such a character that it does not block such good contact. A thin glass coating that will be penetrated by the band 58, when tensioned, is satisfactory.

In the embodiment described in detail hereinabove, the core is of amorphous ferromagnetic alloy. While my invention is especially effective with such a core, the invention in its broader aspects also has application to a core and coil assembly such as shown that includes a core of conventional silicon iron. Such iron, though not as sensitive to mechanical stresses as the usual amorphous alloy, still has some sensitivity; and the clamping means of my invention when used with such a core will substantially reduce core loss and exciting current. In such an embodiment of the invention, all components of the assembly remain the same except for the core, which is of silicon iron, has laminations of about 10 mils in thickness, and has joints in the lower yoke to allow for opening of the core during lacing into the coil structures.

While I have shown and described a particular embodiment of the invention, it will be obvious to those skilled in the art that various changes and modifications may be made without departing from the invention in its broader aspects; and I, therefore, intend in the appended claims to cover all such changes and modifications as fall within the true spirit and scope of the invention.

What I claim as new and desire to secure by Letters Patent of the United States is:

1. In an electric transformer,
(a) a laminated core primarily of amorphous ferromagnetic alloy having two spaced-apart yokes and two spaced-apart legs at opposite ends of said yokes,
(b) two coil structures respectively surrounding said legs, each coil structure having a passageway through which one of said legs extends,
(c) one of said yokes having joints therein which are used to allow for opening of said core during lacing of the core into said coil structures,
(d) clamping plates at the yoke ends of said core and spaced outwardly from said yokes,
(e) means for applying clamping forces to said plates to urge the plates together,
(f) force-transmitting members between said clamping plates and said coil structures for transmitting said clamping force to said coil structures by paths bypassing said core,
(g) said means for applying clamping forces comprising flexible banding that extends through said coil passageways alongside said legs, is held under tension, and engages said core at opposite ends of said one yoke to exert forces on said one yoke acting longitudinally thereof, and
(h) said flexible banding being oriented so as to be spaced from said core at opposite ends of the other of said yokes.

2. The transformer assembly of claim 1 in which:
(a) said one yoke has rounded ends about which said banding is wrapped, and
(b) said legs have substantially vertical outer surfaces closely adjacent which said banding extends in passing through said passageways,
(c) said banding is disposed at an angle of between 0° and +6° to the adjacent outer leg surface at the ends of said one yoke.

3. The transformer assembly of claim 2 in which said banding is disposed at an angle of between 0° and +3° to the adjacent outer leg surface at the ends of said one yoke.

4. The transformer assembly of claim 1 in which:
(a) said legs have substantially vertical outer surfaces closely adjacent which said banding extends in passing through said passages,
(b) said banding is disposed at an angle of between 0° and −6° to the juxtaposed outer leg surface at the ends of said other yoke.

5. The transformer assembly of claim 2 in which said banding as disposed at an angle of between 0° and −6° to the juxtaposed outer leg surface at the ends of said other yoke.

6. The transformer assembly of claim 2 in which said banding is disposed at an angle of between 0° and −2° to the juxtaposed outer leg surface at the ends of said other yoke.

7. The transformer assembly of claim 3 in which said banding is disposed at an angle of between 0° and −2° to the juxtaposed outer leg surface at the ends of said other yoke.

8. The transformer assembly of claim 1 in which:
(a) said core includes an outer wrapper having a thickness that is much greater than that of the amorphous metal laminations of the core, and
(b) said banding contacts said wrapper at the ends of said one yoke.

9. The transformer assembly of claim 2 in which:
(a) said core includes an outer wrapper extending about its outer periphery and having a thickness that is much greater than that of the amorphous metal laminations of the core, and
(b) said wrapper is contacted by said banding at the rounded ends of said one yoke.

10. In an electric transformer,
(a) a laminated core of ferromagnetic alloy having two spaced-apart yokes and two spaced-apart legs at opposite ends of said yokes,
(b) two coil structures respectively surrounding said legs, each coil structure having a passageway through which one of said legs extends,
(c) one of said yokes having joints therein which are used to allow for opening of said core during lacing of the core into said coil structures,
(d) clamping plates at the yoke ends of said core and spaced outwardly from said yokes,
(e) means for applying clamping forces to said plates to urge the plates together,
(f) force-transmitting members between said clamping plates and said coil structures for transmitting said clamping forces to said coil structures by paths bypassing said core,
(g) said means for applying clamping force comprising flexible banding that extends through said coil passageways alongside said legs, is held under tension, and engages said core at opposite ends of said one yoke to exert forces on said one yoke acting longitudinally thereof, and
(h) said flexible banding being oriented so as to be spaced from said core at opposite ends of the other of said yokes.

11. The transformer assembly of claim 10 in which:
(a) said one yoke has rounded ends about which said banding is wrapped, and
(b) said legs have substantially vertical outer surfaces closely adjacent which said banding extends in passing through said passageways,
(c) said banding is disposed at an angle of between 0° and +6° to the adjacent outer leg surface at the ends of said one yoke.

12. The transformer assembly of claim 11 in which said banding is disposed at an angle of between 0° and +3° to the adjacent outer leg surface at the ends of said one yoke.

13. The transformer assembly of claim 10 in which:
(a) said legs have substantially vertical outer surfaces closely adjacent which said banding extends in passing through said passages,
(b) said banding is disposed at an angle of between 0° and −6° to the juxtaposed outer leg surface at the ends of said other yoke.

14. The transformer assembly of claim 11 in which said banding is disposed at an angle of between 0° and −6° to the juxtaposed outer leg surface at the ends of said other yoke.

15. The transformer assembly of claim 12 in which said banding is disposed at an angle of between 0° and −2° to the juxtaposed outer leg surface at the ends of said other yoke.

16. The transformer assembly of claim 10 in which:
(a) said banding is of metal and makes good electrical contact with said core at at least one of the locations that the banding engages the core, and
(b) said banding is electrically connected to ground so as to ground said core.

* * * * *